United States Patent [19]

Braun

[11] Patent Number: 4,521,903

[45] Date of Patent: Jun. 4, 1985

[54] HIGH POWER X-RAY SOURCE WITH IMPROVED ANODE COOLING

[75] Inventor: Martin Braun, San Jose, Calif.

[73] Assignee: Micronix Partners, Los Gatos, Calif.

[21] Appl. No.: 473,483

[22] Filed: Mar. 9, 1983

[51] Int. Cl.[3] ..... G21K 5/00; H01J 35/00

[52] U.S. Cl. ..... 378/141; 378/200; 378/143; 378/144

[58] Field of Search ..... 378/141, 135, 125, 127, 378/121, 143, 144, 130, 199, 200, 34, 142, 129

[56] References Cited

U.S. PATENT DOCUMENTS

| | | | |
|---|---|---|---|
| 4,238,682 | 12/1980 | Vratny | 378/141 |
| 4,258,262 | 3/1981 | Maldonado | 378/200 |
| 4,336,476 | 6/1982 | Holland | 378/144 |
| 4,439,870 | 3/1984 | Poulsen | 378/141 |
| 4,455,504 | 6/1984 | Iversen | 378/141 |

OTHER PUBLICATIONS

Maldonado et al., "X-ray Lithography Source Using a Stationary Solid Pd Target", Journal of Vacuum Science and Technology, 16 (6), Nov./Dec. 1979, pp. 1942–1945.

*Primary Examiner*—Bruce C. Anderson
*Assistant Examiner*—Charles F. Wieland
*Attorney, Agent, or Firm*—Thomas S. MacDonald; Alan H. MacPherson; Richard Franklin

[57] ABSTRACT

In an x-ray source having a cathode emitting electron beams (15, 16) bombarding inner surfaces of an inverted conical anode target cooled by flowing water on its exterior, providing in place of the apex (**14*b*) of the conical anode (34) a rearwardly facing upstream cylindrical extension (34*b***) which insures against apex tip burn-out by extending the cooling structure, area and mass to an upstream position to further dissipate heat energy flux generated by impingement of the electron beam. Portions functioning to effectively cool the anode target extend into non-beam illuminating regions of the target anode.

19 Claims, 6 Drawing Figures

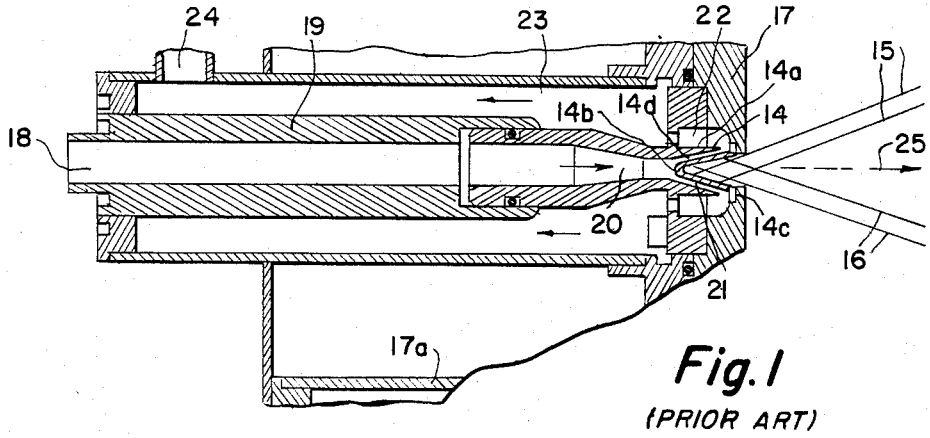
Fig. 1
(PRIOR ART)
Fig. 2
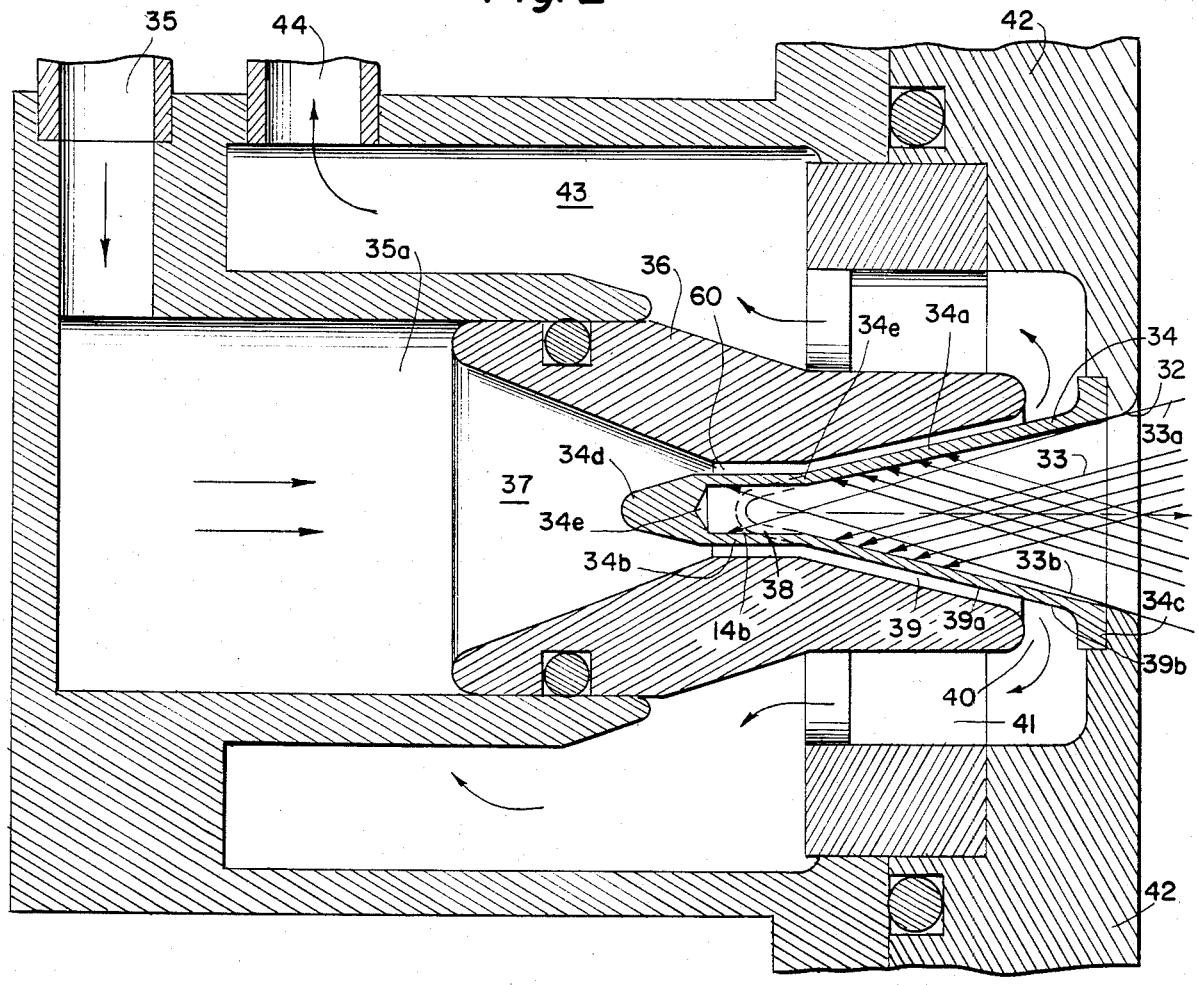

HIGH POWER X-RAY SOURCE WITH IMPROVED ANODE COOLING

BACKGROUND OF THE INVENTION

1. Field of the Invention:

This invention relates to the generation of x-rays particularly useful in x-ray lithographic systems to obtain a uniform x-ray flux emanating from a small spot. Such systems may be used in the fabrication of wafers for large scale integrated circuit production. The invention may also be utilized in x-ray sources for medical radiographic x-ray, diffraction study and tomographic applications. More particularly, it relates to means to more effectively cool the target anode and to prevent burn-out of the conical tip of prior art anodes.

2. Description of the Prior Art

X-rays are utilized in various fields including medical imaging and x-ray lithographic systems for fabricating large scale integration (LSI) semiconductor devices. In certain types of systems the X-rays are formed by an annular-shaped electron gun, various shield and extraction grids and beam focusing devices to effect transmission of a hollow high-energy (about 10–30 keV, typically 25 keV) electron beam on an inverted conical-shaped target. The vast majority, i.e. 99–99.9% of the energy in the beam of electrons bombarding the target, is converted to heat energy but most of the remaining energy produce x-rays which exit through an x-ray transmissive window (typically beryllium for lithography applications) which is part of the enclosure of the overall vacuum system. Generators of this type are disclosed in U.S. Pat. No. 3,665,236 (Gaines et al.), U.S. Pat. No. 3,892,989 (Gralenski et al.), and in Nuclear Instruments and Methods 126 (1975) pages 99–101. Improvements particularly to the cooling of the conical shaped anode are seen in U.S. Pat. Nos. 4,238,682 and 4,258,262 and in the Journal Vacuum Science Technology 16(6) Nov./Dec. 1979, pages 1942–1945 wherein a gun similar to the Gaines et al. electron gun is utilized. Cooling of the target anode is effected by providing a water diverter to provide high water velocity on the back side of the inverted conical anode target so as to establish high velocity turbulent flow resulting in nucleate boiling. This avoids laminar flow or vapor layers forming on that cone back surface. The authors of the Journal Vacuum Science Technology article who include the inventors of the cited improvement patents caution to avoid heating the apex of the cone with the electron beam because to do so will burn out the tip of the cone, since the apex of the cone is not efficiently cooled.

In most applications of x-rays, the greater the intensity of the x-rays, the shorter the exposure. To generate more x-rays, more electrons are pulled from the cathode to impinge on the target. However, the more electrons impinging on the target, the more heat that must be removed from the target. In certain applications the target is rotated to prevent heat from building up. But this results in a complicated structure. In medical x-rays, high power is required over a short period to yield a low average power. In lithography, a high average power is used because the x-ray source is on continuously or almost continuously. Thus, the removal of heat from the conical target is critical.

Electrons hitting the anode target surface penetrate a few microns into the surface. Heat is transferred to the cool side of the target anode where it is removed by high speed coolant, normally water, passing the cool-side surface. Such high speed collant flow is not possible on the apex of the prior art conical target no effort is made at all costs to avoid beam infringement adjacent to or on the apex.

SUMMARY OF THE INVENTION

In accordance with this invention, structure, and methods are provided for obtaining the greatest output of X-rays from a conical anode target of the type where the electron beam impinging on the target is substantially nonparallel or substantially parallel to the axis of rotation of the cone without damaging the anode target which must withstand and dissipate the large flush of heat resulting from electrons impinging on its surface.

The present invention provides structure which decreases and even eliminates the density of the impinging charged particles in the apex region of the anode target thereby to prevent tip "burn-out". In accordance with this invention, the tip of the conical target is extended beyond the inverted conical impingement surface of the target anode. The extension provides additional material mass and area to reduce the heat energy generated per unit area by the impinging beam of charged particles and shields the tip or apex of the target from this beam thereby preventing hot spot formation and thus "burn-out" at the tip. The inward extension of the target is of generally cylindrical configuration, in one embodiment, so that it not only shields the tip but also provides an inner surface of an annular flow area so that coolant flowing in this annulus between both the extension and a surrounding conduit and the downstream main conical anode target surfaces and the surrounding conduit, has greater surface area from which to remove heat than in the prior art. Such construction enables the X-ray generator to be reliably operated at high beam densities for long periods.

In an alternative embodiment of this invention, the cylindrical extension of the anode cone is cut by a substantially flat plane oriented at an angle to the longitudinal axis of the cylinder thereby to provide an ellipsoidal line of intersection of the cylinder through the flat plane. Because the flat plane is angled relative to the longitudinal axis of the cylinder, incident electrons entering in a direction parallel to the axis of rotation of the anode cone which in the prior art would strike the apex of the target anode now strike the flat surface of the extension of the anode. In this embodiment, the incident energy per unit area of the flat portion of the extension can be controlled by carefully selecting the proper angle for this flat section with respect to the angle of incidence of the electrons. With regard to embodiments containing a substantially V-shaped groove, the rearward extension of the target constitutes substantially a continuation of at least one of the two surfaces of the V-groove rearwardly at a reduced angle with regard to the plane of symmetry.

This invention will be more fully understood in conjunction with the following detailed description taken together with the drawings.

BRIEF DESCRIPTION OF THE DRAWINGS

FIG. 1 is a partial cross-sectional view of the cooling system for the conical target anode of the prior art.

FIG. 2 is a partial cross-secional view of the cooling system for the improved anode target of this invention.

DETAILED DESCRIPTION

Figure 3:
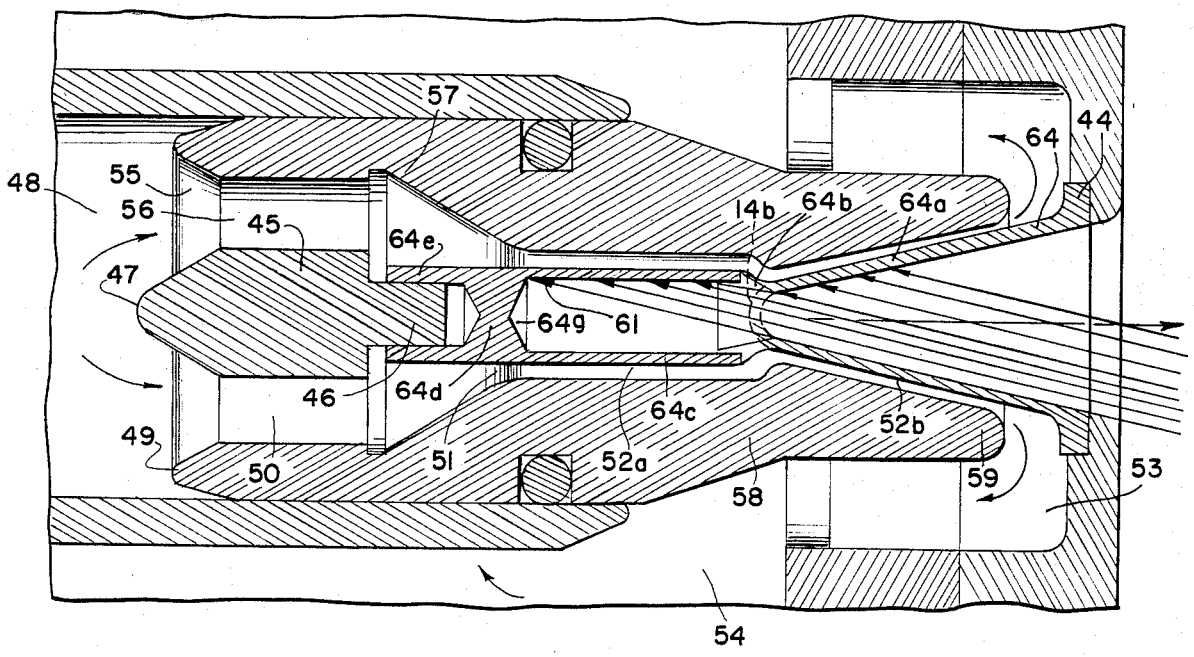
FIG. 3 is a partial cross-sectional view of a modified form of cooled target anode.

A prior art device generally similar to that shown in U.S. Pat. No. 4,238,682 is shown in FIG. 1. A conical target anode 14 is mounted in a facing plate 17 of the anode portion of the overall X-ray source system. The term "conical" as used herein includes converging surfaces such a those surfaces of revolution which are conical or are substantially conical such as a hyperbola formed by a vertical section of a right circular cone. It also includes a V-shaped peripheral notch in a cylindrical rotating anode, and the "axis of revolution" of the conical target is substituted for by the symmetry plane of the V-shaped groove of the rotating anode.

The "tip" or "apex" of the conicl target includes surfaces adjacent to the point where the axis of revolution meets the inner cone surface or, in the alternate embodiment, the points where the symmetry plane of the V-shaped groove meets the inner V-groove surface. Cathode structure for generating the high energy electron beam is omitted from the drawing but is shown in U.S. Pat. Nos. 4,238,682 and No. 4,258,262, the disclosures of which are herein incorporated by reference. The designation "electron beam" is used to mean any beam of charged particles used to generate X-rays. The electron beams 15, 16 exit the cathode in the form of a hollow ring of electrons which bombard the inner surface 14*a* of the inverted conical anode 14 to cause the emission of x-rays 25 from the anode surface 14*a*. These beams are schematically shown as sets of beams 15 and 16 focused by suitable well-known focusing means at the cathode (not shown) to strike the inner surface 14*a* of anode 14. Care is taken to avoid having any part of the beams 15 and 16 strike the apex 14*b* of anode 14 which would cause burn-out, of or even the formation of an actual hole in the apex 14*b* by reason of the heat generated by electrons impinging at the apex. The design of the prior art anode results in an inability to cool adequately the apex 14*b* with the cooling system.

Anode rim 14*c* is mounted in faceplate 17 by brazing. Rim 14*c* is at the wide diameter base of the anode inverted cone. Since the anode structure is cylindrical and the beams emitted from the cathode are circular, the cross-sectional view in each of the FIGS. 1–4 is a symmetrical one.

Various means can be employed to cool the target anode from the high heat flux imposed by the bombardment of the electrons 15, 16. In one embodiment, a coolant inlet source 18 is provided along with a coolant inlet passageway 19 for conducting a specially-treated deionized water coolant through a cylindrical conduit 20 into an annular flow passage 21 formed between that portion of the inner surface of conduit 20 surrounding anode 14 and the outer surface 14*d* (i.e., the surface opposite impingement surface 14*a*) of the conical anode 14. Coolant is pumped through the annulus 21 effecting cooling typically by nucleate boiling. The coolant exits through coolant outlet chamber 22 and passes rearwardly through coolant exit passageway 23 to outlet 24. If the beam-forming electrodes as shown in U.S. Pat. No. 4,258,262 malfunction in any way and the beam varies in its direction, the beam is capable of impinging on the apex area 14*b* where the heat flux cannot be adequately removed by the coolant system. This then can cause catastrophic damage and burn-out of the apex 14*b* of the target anode 14.

FIG. 2 show the preferred embodiment of applicant's invention wherein an improved anode target 34 is provided. Anode target 34 comprises a conical target with an inner surface of revolution 34*a* onto which the bombarding electrons impinge. The conical target anode is truncated at 34*e* and a cylindrical extension 34*b* is connected thereat to extend the apex 34*e* of the target 34 upstream or inward towards the cooling source. As in the prior art, the target is secured in place by an anode target base or rim 34*c* which is fastened into an anode system front closure plate 42. Front closure plate 42 has a circular aperture 32 through which the electron beams 33 pass into the inverted cone. X-rays resultant from the bombardment exit from the target through aperture 32 as shown by the axial arrow and are subsequently directed as shown for example in FIG. 1 of U.S. Pat. No. 4,258,262. Extending further upstream from the cylindrical hollow extension 34*b* and defining the shape of apex 34*e* is a bullet-shaped diverted section or end piece 34*d* which extends into the flow of coolant. End piece 34*d* diverts the coolant flow into annulus 60 surrounding the cylindrical extension 34*b* and into the annulus 39 between the principal anode target area 34*a* and conduit 36. The original apex 14*b* of the prior art device is shown in dotted lines to illustrate the position of the extension 34*b* and apex 34*e* in accordance with this invention rearward of the hypothetical apex 14*b* of truncated cone section 34*a*. Apex 14*b* is not actually present in eitherr of the FIG. 2 or 3 embodiments.

A coolant source inlet 35 and inlet passage 35*a* are provided upstream of conduit 36. A conduit entrance 37 conducts cooling fluid into the region of the diverter end piece 34*d*. The cooling medium, such as deionized water, is conducted through annular flow passage 60 between the walls of the inner surface of conduit 36 and the outer surface of cylindrical extension 34*b* and further downstream between the conduit 36 and the anode wall section 34*a*. In order to accommodate the extension 34*b* and end piece 34*d* the target 34 has a portion shown by the dashed line 38 removed therefrom in order to provide a suitable entrance annulus for coolant fluid to the downstream passgeway 39.

In operation, coolant medium, i.e., fluid in a turbulent state passes through coolant passgeway 39 between the conduit 36 and anode 34 where it cools the anode for example, by nucleate boiling, and then into coolant exit chamber 40. The heated water then exits through coolant exit passage 41 and a coolant exit passgeway 43 to a coolant exit outlet 44. The flow of coolant is shown in FIG. 2. It is contemplated that flow of coolant may be in the opposite direction. In such event the coolant flow rates and the flow passages would be modified to optimize the heat transfer from the cone and extension surfaces.

The nature of the cooling of the target required is apparent when one realizes that the electrons typically have an energy of from 10–30 keV and that most of the energy of the electrons impinging upon the target becomes heat with the remainder becoming X-rays. The electrons scatter in the target material and x-rays are generated as a result. The soft x-rays typically have a wavelength about two hundredths to two thousandths of that of light, i.e., 2–20 Angstroms. The electrons penetrate a few microns at most into the surface of the target material, so most of the heat in the target is generated within a few microns of the inner surface of the target. This heat must be transferred to the outer or "cool side" of the target. Typically, deionized water is used to remove the heat from the target. However, sufficient energy is generated by the target that the water used to cool the target normally boils as it passes the target. The boiling of the water avoids the formation of a laminate layer and increases the efficiency with which heat can be removed from the target.

The cylindrical extension 34*b* of this invention decreases the electron density impinging upon the target material in the region of the cylindrical extension. However, generally it is desirable that the electrons hit only the side of the conical portion of the target and not the sides of the cylindrical extension. As will be shown shortly, the energy generated per unit area of the cylindrical extension can also be reduced by making the cylindrical extension of greater diameter.

In order to provide substantially uniform water flow and velocity through conduit 36, the slopes 39*a* and 39*b* of the conduit 36 and the surface of revolution 34*a* vary so that the annulus 39 becomes narrower as it progresses downstream towards the target base 34*c*. Maintenance of substantially constant cross-sectional area across the annulus 39 is provided by the narrowing of the conduit.

As is shown, extension 34*b* extends rearwardly toward the upstream coolant flow and away from base 34*c* such that the hollow cylindrical extension 34*b* is outside the impingement areas of the norml operating means exiting from the cathode and impinging the region of surface 34*a*. The extension 34*b* is adequately cooled by the high speed passage of coolant through the annulus 60 and the mass and area of end piece 34*d* is sufficient to act as a heat sink such that any stray or variable beams of electrons, such as any striking inwardly of beams 33*a* and 33*b*, which might, due to malfunction or other cause, impinge in the upstream area of the cylindrical extension will not puncture or otherwise destroy or burn-out the upstream tip end of the anode target. It may be advantageous to utilize other high melting, high thermal conductivity materials such as molybdenum for the extension so it better withstands the high heat flux. In such event, the conical portion may be of a different material which has the desired x-ray radiation, such as palladium. The cylindrical extension 34*b* effectively shields the top or apex 34*e* from the incident electrons and thus prevents tip burn-out.

FIG. 3 is a modification of the improved anode target of this invention. The extension 34*c* to the anode target 64 in FIG. 3 comprises a conical bridging member 64*b* integrally attached to the truncated end 64*f* of the region 64*a* of target 64 on which electrons impinge. A cylindrical section 64*c* is connected to the other end of member 64*b*. A solid root portion 64*d* connects the cylindrical section 64*c* to a cylindrical end 64*e* into which a diverter connector 46 extending from the front surface of diverter 45 is inserted. The bullet-shaped nose 47 of the diverter 45 extends in juxtaposed spaced position slightly beyond the front edge 49 of the cylindrical conduit 58. Diverter 45 may be cantilevered into the coolant stream as shown or may be supported by a spider of radial arm(s) extending between the diverter and member 58. Cooling medium or fluid (preferrably deionized water as described above) passes, as shown by the arrows, from passage 48 through inwardly inclined entrance 55 to a cylindrical passgeway 56, bounded by exterior wall 50 and a tapered entrance section 57 to the annulus entrance 51. An annulus 52*a* extends between the target cylindrical extension 64*c* and the inner peripheral surface of conduit 58 and a connected downstream tapered annular passageway 52*b* extends between the outer surfaces of impingement area 64*a* of the target anode 64 and a forward-extending tail piece 59 of conduit 58. Cooling fluid flows in the direction shown by the arrows and, after cooling the anode target, the cooling fluid is conducted through coolant exit chamber 53 rearwardly through coolant exit passageway 54 to an exit (not shown).

In FIG. 3 the electron beam array is permitted to pass through the former apex position 14*b* internally of extension section 64*c* where it can impinge as illustrated by beam ray 61. At this position, there is sufficient exterior cooling of extension 64*c* to prevent any damage to the anode target and direct impingement of the electrons 61 on the tip or apex 64*g* of the target 64 is prevented by cylindrical extension 64*c*. The various extensions and/or diverters in the various embodiments may have exterior surfaces which are textured or roughened to increase turbulence and heat transfer or may include longitudinally-extending fins to present more surface area to the cooling medium.

Figure 4:
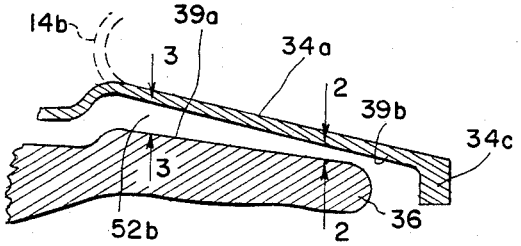
FIG. 4 is a detailed cross-secional view of a portion of the coolant passages between the coolant conduit and surface of revolution of the target anode.

FIG. 4 is a partial view showing the narrowing of the passageway 52*b* (FIG. 3) by providing varied slopes on the inner peripheral surface of conduit 36 (FIG. 2) or conduit 58 (FIG. 3) and on the outer cool side surface 39*b* of the anode target. In one embodiment, the slope of the surface 39*a* on conduit 36 will be 11° and the slope of surface 39*b* would be 12.5°. This provides a continually narrowing passageway or annulus as coolant progresses from station 3—3 to station 2—2 along the cool-side surface of the anode target.

Figure 5:
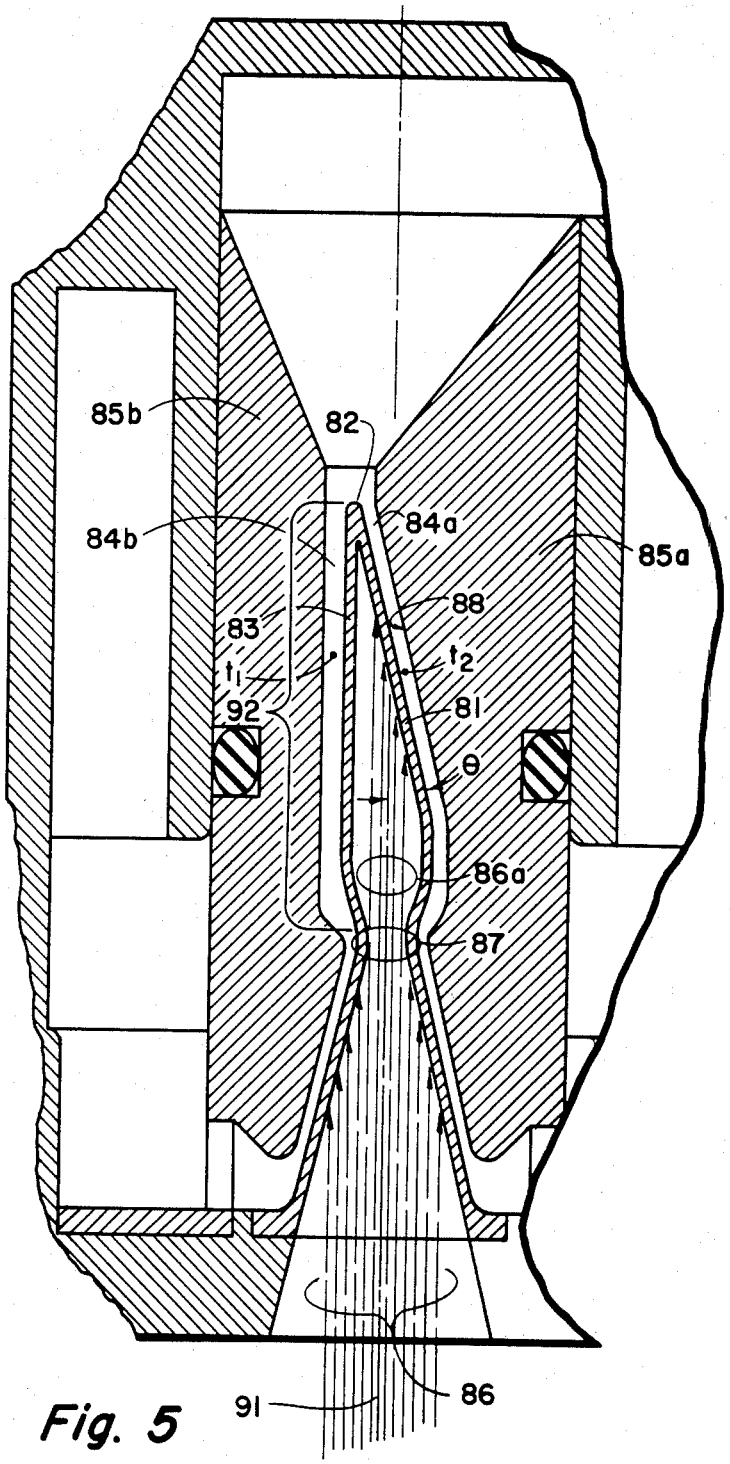
FIG. 5 is a detailed cross-sectional view of an alternative embodiment of this invention employing an cylindricl extension of the apex of the target anode angularly truncated by a flat surface adapted to be impinged upon by incident electrons.

FIG. 5, illustrates another embodiment of this invention wherein the cylindrical extension of the target anode of this invention such as shown in FIG. 3 or in FIG. 2 is angularly truncated by a flat wall 81. The remaining cylindrical portion 83 connected to wall 81 by tip 82 is parallel to the longitudinal axis 91 of the cylinder of the extension. The inner surface of flat wall 81 is arranged to intercept those incident substantially parallel-to-the-axis electrons 86 which would normally have hit the apex or tip of the prior art target anode but which now pass through opening 87 created by the removal of the tip (such as tip 14*b* as illustrated in FIG. 3). A portion of the electrons 86 denoted by those electrons circled 86*a* in FIG. 5 strike the flat angular truncation of cylinder 83. The angle theta between the beam of incident electrons 86*a* and the flat truncated wall 81 determines the incident energy per unit area on the surface of wall 81 and thus the heat flux which must be removed from this surface. Channel 84*a* is provided directly adjacent the outer surface of flat truncated wall 81 and is adapted for the passage of a fluid under pressure for the removal of heat from material 81. Channel 84*a* is subtantially planar in the regions adjacent wall 81 but is cylindrical (i.e., a curved annulus) adjacent the other porions of cylindrical wall surface 83. Thus channel 84*b* is formed between the outer surface of cylindrical portions of the extension 92 and the inner surface of diverter 85*b*. The channel thickness $t_1$ between these two surfaces must be controlled in such a way so as to insure that the fluid flow through flat channel 84*a* adjacent the flat wall surface upon which the electron beam 86*a* strikes is adequate to provide sufficient cooling capacity to cool the wall 81 and prevent burnout of the extension 92 of the tip. The thickness $t_2$ of substantial flat channel 84*a* between the outer surface of flat wall 81 and a flat inner surface 88 of diverter portion 85*a* generally coincident to wall 81 must be properly dimensioned along with thickness $t_1$ to insure the proper fluid flow through the channels 84*a* and 84*b*. Channels 84*a* and 84*b*, of cource, merge at the longitudinal edges of the truncation. Diverter position 85*a* may be a flat faced insert provided in the overall diverter structure.

In a typical operation with incident energy being in the range of from 4 to 10 kilowatts, a flow of three gallons per minute of de-ionized water at room tempraturе prior to passing the target anode has been found adequate to prevent the target channel from burning out.

Channel 52*b* (FIG. 4) has a channel width of about 15 mils (0.015 inches) at section 3—3 at the beginning of channel 52*b* and a thickness of 10 mils at section 2—2 near the exit from this channel. Three gallons of deionized water per minute were pumped through this annular channel during the operation of the target anode of the type shown in FIG. 2 with the incident energy being approximately 7.5 kilowatts.

Figure 6:
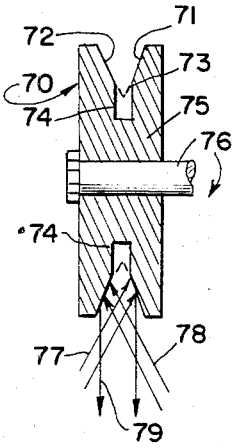
FIG. 6 is a cross-sectional view of a rotating anode embodiment of this invention.

A rotating anode which continually presents a new surface for exposure to the electron beam may also be employed in practicing the invention. FIG. 6 shows a rotating cylindrical anode 70 having a V-groove kerf in its outer periphery forming two inwardly converging surfaces 71, 72. In order to prevent incidence of multiple high energy beams i.e., a high concentration of power at the inward intersection 73 of those surfaces (corresponding to the apex 14 *b* in FIGS. 2 and 3), a rearward hollow extension 74 is provided resulting in a beam-facing expanse of surfce which can transfer the heat generated by stray or desired infringing beams. Normally an array of beams 77, 78 will strike surfaces 71, 72 and x-rays 79 will be emitted from the surfaces 71, 72. Sufficient mass of metal or other heat sink material sufficient to thermally conduct generated heat from the surfaces 71, 72 and that heat flux generated within extension 73 is provided. The anode is rotated by suitable means (not shown) connected to a central shaft 76 which is connected to the anode. Anode 70 while shown with solid material cooling means 75 may contain passageways for the flow of liquid or slurry coolants.

The conical or rotating anode, more particularly the electrons beam-impinged conical surface, may be made of various metals or composite materials which emit x-rays. These include Al, Cu, Si, Pd, W, Mo or a rhenium-tungsten alloy. An insert of the target material may be brazed, sputtered or evaporated on the conical surface or either the fixed conical anode or the rotating anode.

The above description of the advantages and embodiments of this invention is intended to be illustrtive only and not limiting. Other embodiments of this invention will be apparent to those skilled in the art in view of the above disclosure.

I claim:

1. In an X-ray generator having a target anode with a hollow substantially converging cross-sectional inside surface forming the principal region of bombardment by a beam of charged particles entering the hollow target anode from an open base end, to cause the emission of x-rays therefrom and having means for dissipating and removing generated heat in direction away from said region of bombardment, the improvement comprising:

(a) said surface being truncated at its smaller diameter end opposite its larger diameter open base end; and (b) a hollow extension connected to said truncated end and extending in a direction away from said base end and for a distance greater than the top of a hypothetical apex of said converging surface.

2. The invention of claim 1 in which said hollow extension comprises an elongated section attached to said truncated end and a coalent diverter connected to said section extending in a rearward direction, said section and said diverter forming said means to remove heat generated by said bombardment.

3. The invention of claim 1 in which said extension is a solid material of sufficient mass to dissipate heat generated in said target anode by said bombardment.

4. The invention of claim 1 wherein said cooling means includes a cylindrical conduit extending contiguously with said converging surface and said extension, said conduit forming a cylindrical annulus between a portion of in inner peripherl surface and an outer peripheral surface of said extension shaped to direct liquid coolant flow.

5. The invention of claim 4 in which said conduit includes a rounded entrance section to introduce coolant onto the exterior peripheral surfaces of said extension and converging surface.

6. The invention of claim 4 in which said cylindrical conduit has a sloped inner peripheral surface and said converging surface has an outer periphery extending toward its base of greater slope, such that the annulus between said surfaces becomes narrower along a direction from said truncated end to said base end.

7. The invention of claim 2 in which said diverter extends into a source of coolant fluid.

8. The invention of claim 2 further including a diverter attached to said extension, said diverter being juxtaposed at and centrally deposed in an entrance section of said conduit.

9. The invention of claim 2 in which said elongated section directly extends from said truncated end.

10. The invention of claim 2 in which said elongated section is integral with said truncated end.

11. The invention of claim 2 including a hollow reverse conical bridging member extending between said elongated section and said converging surface.

12. The invention of claim 2 in which said elongated section extends inwardly upstream of coolent flow a sufficient distance so that a charge particle beam may not penetrate beyond the hollow interior of said extension.

13. The invention of claim 2 in which said elongated section is in a normally non-beam bombarded region of said target anode.

14. The invention of claim 2 in which a portion of said elongated section is sufficiently cooled to permit illumination of said portion by said charged particle beam bombardment.

15. The invention of claim 1 wherein said hollow extension has an angularly truncated flat wall section extending across the longitudinal axis of said hollow extension.

16. The invention of claim 15 wherein said truncated flat wall section intercepts x-rays entering said hollow extension in substantial parallelism to the longitudinal axis of said surface of revolution.

17. The invention of claim 4 wherein said hollow extension has an angularly truncated flat wall section extending across the longitudinal axis of said hollow extension and said cylindrical conduit has an inwardly facing flat portion spaced from and generlly coincident to said truncated flat wall section.

18. The invention of claim 1 wherein said target anode comprises a rotating cylinder including a V-groove kerf having converging sides extending inwardly from a peripheral outside edge of sid cylinder and wherein said hollow extension extends radially inwardly from said converging sides.

19. The invention of claim 1 in which said converging surface is a conical surface of revolution.

* * * * *

UNITED STATES PATENT AND TRADEMARK OFFICE

CERTIFICATE OF CORRECTION

PATENT NO. : 4,521,903

DATED : June 4, 1985

INVENTOR(S) : Martin Braun

It is certified that error appears in the above—identified patent and that said Letters Patent is hereby corrected as shown below:

Column 2, line 3, change "no" to --so--.

Column 2, line 14, change "flush" to --flux--.

Column 2, line 35, between "has" and "greater" insert --a--.

Column 3, lines 7 & 8, correct spelling of "cylindricl" to --cylindrical--.

Column 4, line 11, change "show" to --shows--.

Column 4, line 29, change "diverted" to --diverter--.

Column 4, line 39, change "eitherr" to --either--.

Column 4, line 60, between "shown" and "in" insert --by the arrows--.

Column 5, line 37, change "norml" to --normal--.

Column 5, line 38, change "means" to --beams--.

Column 7, line 13, change "cource" to --course--.

UNITED STATES PATENT AND TRADEMARK OFFICE

CERTIFICATE OF CORRECTION

PATENT NO. : 4,521,903

DATED : June 4, 1985

INVENTOR(S) : Martin Braun

It is certified that error appears in the above—identified patent and that said Letters Patent is hereby corrected as shown below:

Column 7, lines 19 & 20, change spelling of "temprature" to --temperature--.

Column 7, line 42, change "surfce" to --surface--.

Column 7, line 64, change "illustrtive" to --illustrative--.

Column 8, line 7, between "in" and "direction" insert --a--.

Column 8, line 18, change "coalent" to --coolant--.

Column 8, line 29, change "in" to --its--.

Column 8, line 56, change "coolent" to --coolant--.

Column 9, line 6, delete "surface of revolution" and insert --hollow extension--.

Column 10, line 1, change "generlly" to --generally--.

Column 10, line 6, change "sid" to --said--.

Signed and Sealed this

*Nineteenth* Day of *November 1985*

[SEAL]

*Attest:*

DONALD J. QUIGG

*Attesting Officer*

*Commissioner of Patents and Trademarks*